US007316099B2

(12) United States Patent
Faulkner et al.

(10) Patent No.: US 7,316,099 B2
(45) Date of Patent: Jan. 8, 2008

(54) SPACED SHEATHING ROOFING SYSTEM AND METHOD OF INSTALLING SAME

(75) Inventors: David H. Faulkner, Bradenton, FL (US); Robert L. Ferrante, Davie, FL (US); E. Richard Huber, Houston, TX (US); Pat L. Murray, Springs, TX (US)

(73) Assignee: Polyfoam Products, Inc., Tomball, TX (US)

( * ) Notice: Subject to any disclaimer, the term of this patent is extended or adjusted under 35 U.S.C. 154(b) by 0 days.

(21) Appl. No.: 10/294,386

(22) Filed: Nov. 14, 2002

(65) Prior Publication Data

US 2003/0089064 A1 May 15, 2003

Related U.S. Application Data

(60) Provisional application No. 60/334,631, filed on Nov. 15, 2001.

(51) Int. Cl.
*E04B 5/00* (2006.01)

(52) U.S. Cl. ..... 52/408

(58) Field of Classification Search ..... 52/408, 52/746.11, 748.1, 748.11, 742.13; 428/57, 428/192, 194; 156/297, 299, 78, 79
See application file for complete search history.

(56) References Cited

U.S. PATENT DOCUMENTS 2,151,794 A * 3/1939 Peebles ..... 52/540
2,152,080 A 3/1939 Munsey
3,200,026 A 8/1965 Brown
3,411,256 A 11/1968 Best
3,646,715 A 3/1972 Pope
3,698,972 A 10/1972 Lenzner
3,760,546 A 9/1973 Martin et al.
4,036,673 A 7/1977 Murphy et al.
4,063,395 A 12/1977 Stewart et al.
4,087,296 A 5/1978 Hooker (Continued)

FOREIGN PATENT DOCUMENTS

EP 0135913 A2 4/1985

(Continued)

OTHER PUBLICATIONS

Amex Brochure in Japanese; 29 pages, (date unknown), no English translation available.

(Continued)

*Primary Examiner*—A. Joseph Wujciak, III
(74) *Attorney, Agent, or Firm*—Douglas W. Rommelmann; Andrews Kurth LLP

(57) ABSTRACT

The present invention is a spaced sheathing roofing system and method in which roof cladding is placed onto batten strips positioned on roof rafters. The roof cladding is attached using an adhesive. The attachment component is preferably a polymer adhesive, more preferably a polyurethane, for adhering the roof cladding. The adhesive is preferably sprayed onto the lower surface of the placed roof cladding while also being sprayed onto the batten strips and the supporting truss rafters. The sprayed adhesive bonds the adjacent roof cladding together and also bonds the roof cladding to the batten strips to form a monolithic structure. In addition, the sprayed layer of adhesive forms an insulative layer while also forming a waterproof barrier.

32 Claims, 3 Drawing Sheets

U.S. PATENT DOCUMENTS

| | | | | |
|---|---|---|---|---|
| 4,160,346 | A | 7/1979 | Kaufmann | |
| 4,244,901 | A | 1/1981 | Wencley et al. | |
| 4,315,391 | A | 2/1982 | Piazza | |
| 4,636,425 | A | 1/1987 | Johnson et al. | |
| 4,707,961 | A | 11/1987 | Nunley et al. | |
| 4,996,812 | A | 3/1991 | Venable | |
| 5,219,097 | A | 6/1993 | Huber et al. | |
| 5,253,461 | A | 10/1993 | Janoski et al. | |
| 5,362,342 | A | 11/1994 | Murray et al. | |
| 5,441,583 | A | 8/1995 | Eaton et al. | |
| 5,895,536 | A | 4/1999 | Starr et al. | |
| 5,951,796 | A | 9/1999 | Murray | |
| 6,023,906 | A * | 2/2000 | Folkersen | 52/746.11 |
| 6,164,021 | A | 12/2000 | Huber et al. | |
| 6,314,700 | B2 * | 11/2001 | Starr | 52/540 |
| 6,357,193 | B1 * | 3/2002 | Morris | 52/553 |
| 6,393,796 | B1 * | 5/2002 | Goettl et al. | 52/733.2 |
| 6,519,905 | B1 * | 2/2003 | Knighton | 52/378 |
| 6,679,018 | B2 * | 1/2004 | Georgeau et al. | 52/408 |
| 2002/0095898 | A1 * | 7/2002 | Bettencourt | 52/506.05 |
| 2004/0011354 | A1 * | 1/2004 | Erling | 126/621 |

FOREIGN PATENT DOCUMENTS

| | | |
|---|---|---|
| EP | 0497725 A1 | 8/1992 |
| GB | 1257826 | 12/1971 |
| JP | 2304165 | 12/1990 |
| JP | 5112770 | 7/1993 |
| WO | WO 99/43906 | 9/1999 |

OTHER PUBLICATIONS

Monier-Raymond Company, Technical Bulletin 671 "*Spaced Sheathing*"; 2 pages (date unknown).

Monier Roof Tile; specifications and drawings; sheathing spacing (simple roof/complex roof); undated; pp. 5, 6; published by Monier Roof Tile, Orange, California.

* cited by examiner

FIG. 1
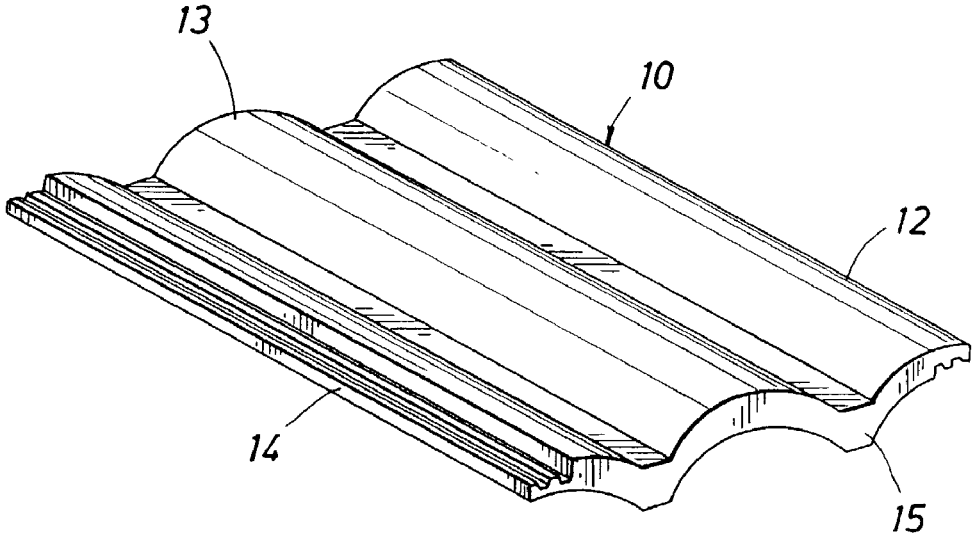
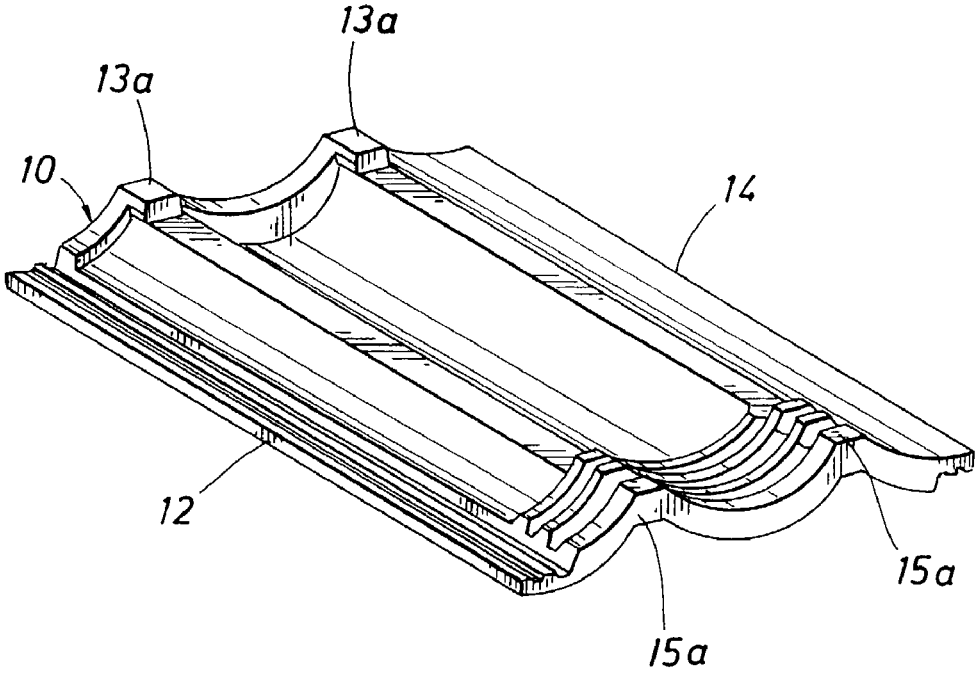
FIG. 2

FIG. 4
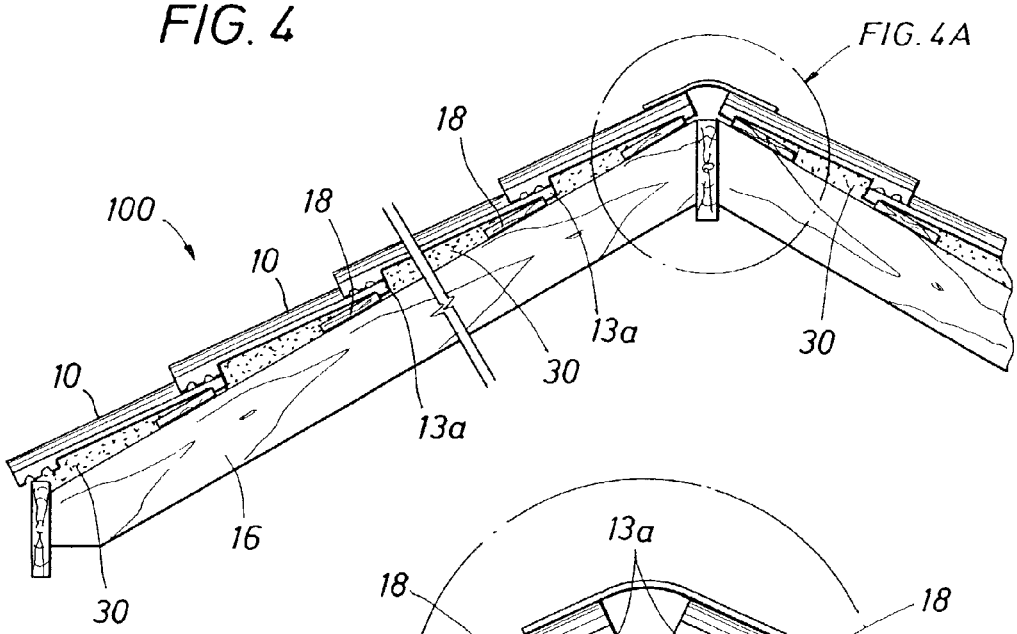
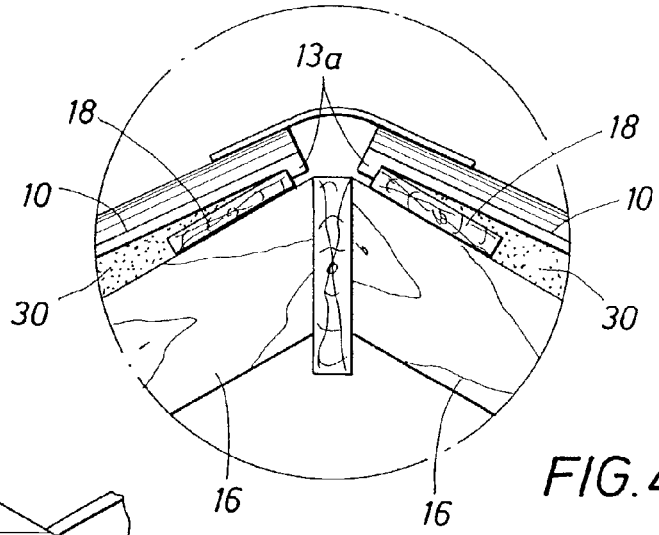
FIG. 4A
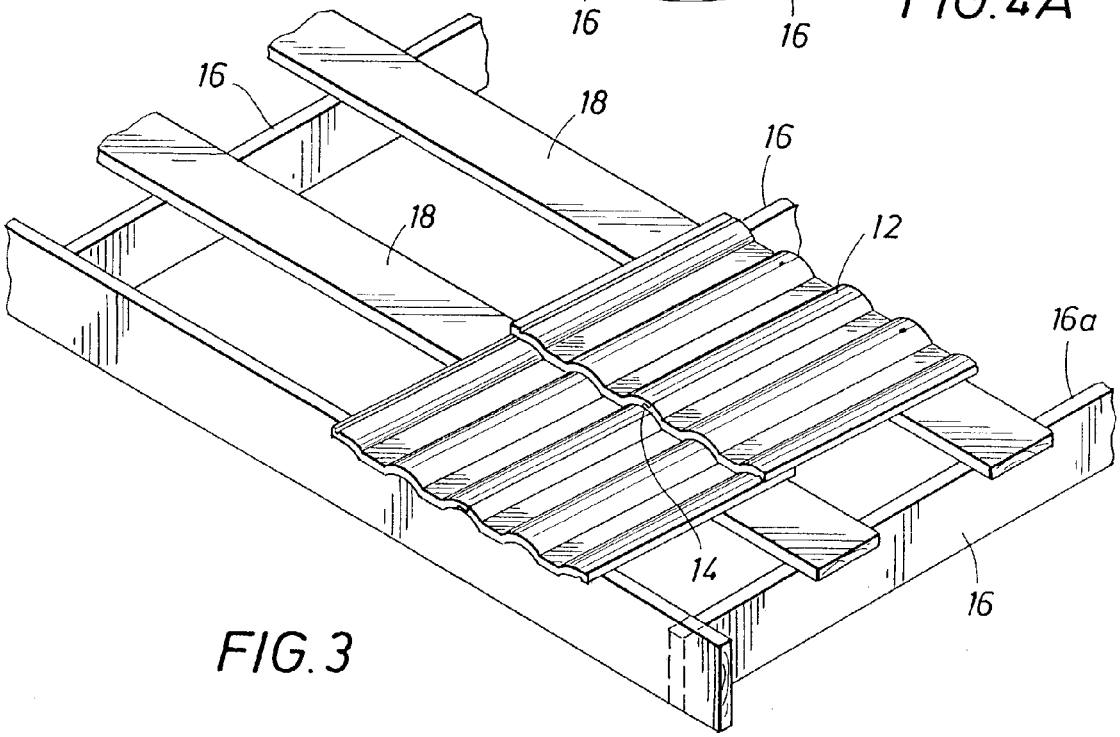
FIG. 3

SPACED SHEATHING ROOFING SYSTEM AND METHOD OF INSTALLING SAME

CROSS-REFERENCE TO RELATED APPLICATIONS

The present application claims priority from U.S. Provisional Application Ser. No. 60/334,631, filed Nov. 15, 2001.

STATEMENTS REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to a spaced sheathing roofing system and method of installing same, and particularly to a spaced sheathing roofing system providing enhanced insulation and waterproofing properties.

2. Description of the Related Art

There are two basic techniques of pitched roof construction. The most common technique involves nailing sheets of wood, typically plywood or decking material, to truss rafters to form a pitched roof deck. The pitched roof deck is overlaid with a roof substrate made of a waterproofing material. Typically, the waterproofing material forming the roof substrate is a roll goods membrane or underlayment comprising one or more plies of asphaltic or modified bitumen impregnated felt attached to the pitched roof deck by nails and/or adhesive. Felt is generally made of wood pulp and rag or of asbestos, polyester or glass fibers. Roof cladding provides the outer roof covering on the pitched roof system. One example of roof cladding is a roof tile. Roof tiles are extremely durable and provide significant aesthetic and decorative effects to the structures to which they are applied. Roof claddings may be made of cementitious materials and also brick, stone, clay, plastic, wood, metal, rubber or bituminous materials.

Roof cladding is secured primarily to the pitched roof system with mechanical fasteners. Nails are the primary mechanical fasteners for securing roof cladding to a wood deck. Roof tiles are commonly secured with a nail inserted through a hole in the roof tile and driven through the roof substrate and wood deck. Mortar is sometimes used in conjunction with nails to provide holding force of the roof tile to the roof deck.

The use of a plural component adhesive for attaching roof cladding to the exterior surface of a pitched roof deck is disclosed in assignee's U.S. Pat. No. 5,362,342. The '342 patent discloses a method of bonding tile roof components to the roof substrate utilizing polyurethane foam as the bonding medium. The method includes the step of applying under low pressure a stream of two component foamable liquid polyurethane on a prepared roof substrate. The foamable liquid polyurethane has a density preferably in the range of one and one-half to two pounds per cubic foot and a reactivity period in the range of one and one-half to four minutes. The foamable liquid polyurethane is preferably applied at a rate in the range of two to three pounds per minute. The tile roof component is placed into contact with the foamable liquid polyurethane during the reactivity period of the foamable liquid polyurethane.

The second technique of pitched roof construction is referred to as a spaced sheathing roof assembly. This technique has more limited applications and is used in certain geographic locations. In the spaced sheathing technique, batten strips, generally two to six inches wide, are affixed perpendicularly to the truss rafters and spaced according to the dimension of the selected roof cladding. The roof cladding, typically concrete or clay roof tiles, are allowed to be loose lain on the batten strips. Alternatively, the roof tiles may be occasionally nailed to the batten strips. When desired, an optional underlayment is positioned above the truss rafters and below the batten strips. Ferrous roof panels may be installed, using a limited number of mechanical fasteners on similarly arranged batten strips. Nonferrous cladding such as wood shingles may be installed and nailed to the batten strips in the same manner.

In the conventional spaced sheathing roof assembly, each of these roof coverings offers its own economic and aesthetic advantage, but all have similar shortcomings. The shortcomings of the spaced sheathing roof assembly are that it provides little or no insulation value to the structure, little protection from leaking during high wind and unexpected high rainfall events as well as, structural movement or racking of the roof assembly during high wind events and seismic disturbances.

It is desirable to have a spaced sheathing roof system that provides insulative value to the structure, significant leak protection and resistance to structural movement or racking of the roof assembly. It is also desirable to have an adhesive attachment assembly and method for concrete, slay and slate roof tiles and ferrous and non-ferrous roof panels for spaced sheathing applications.

Furthermore, it is desirable that the method of installation be simple, non-labor intensive, economical and not require excessive installation time. Furthermore, the roofing system should withstand the long-term effects of temperature and climatic variations experienced by the roofing system under normal circumstances

BRIEF SUMMARY OF THE INVENTION

The present invention is an improved spaced sheathing roof system that provides insulative value to the structure, significant leak protection and resistance to structural movement or racking of the roof assembly. The present invention includes an adhesive attachment assembly and method for concrete, slay and slate roof tiles and ferrous and nonferrous roof panels for spaced sheathing applications. Furthermore, the method of installation of the present invention is simple, non-labor intensive, economical and does not require excessive installation time. Furthermore, the roofing system of the present invention will withstand the long-term effects of temperature and climatic variations experienced by the roofing system under normal circumstances.

One embodiment of the present invention is a spaced sheathing roofing system and method in which roof cladding is placed onto batten strips positioned on roof rafters. The roof cladding is attached using an adhesive in the spaced sheathing application of the present invention. The attachment component of the present invention is preferably a polymer adhesive, more preferably a polyurethane, for adhering the roof cladding. The adhesive is preferably sprayed onto the lower surface of the placed roof cladding while also being sprayed onto the batten strips and the supporting truss rafters. The sprayed adhesive bonds the adjacent roof cladding together and also bonds the roof cladding to the batten strips to form a monolithic structure. In addition, the sprayed layer of adhesive forms an insulative layer while also forming a waterproof barrier.

Due to the unexpected climatic and seismic changes in various geographic locations, a method to provide secure attachment of the desired cladding has been developed. The application of insulating adhesive to the underside of each of the aforementioned claddings provides the necessary solution to address the shortcomings of the spaced sheathing roofing system. The application of the insulating adhesive locks together each member of the roofing system, cladding, batten strips and rafters, providing a substantially stronger roof assembly. The insulating adhesive is preferably a polyurethane chemical system, and more preferably a plural component polyurethane chemical system. A preferred insulating adhesive is a froth polyurethane adhesive and more preferably a froth foam polyurethane adhesive. Further, the polyurethane insulating adhesive has a dramatic effect on lessening the heat energy transfer into the attic space, thus lowering energy cost; provides "walk-ability" of the selected cladding by providing reinforcement to the underside of the cladding; eliminates the need for a waterproofing membrane since the insulating adhesive completely seals the underside of the selected cladding material; and during high wind events or seismic activity the polyurethane adhesive prevents loss of the roof cladding due to the resultant monolithic nature of the roof structure as a benefit of the adhesive application.

The method of the present invention can be used to adhesively attach concrete, slay, and slate roof tiles and ferrous and non-ferrous roof panels for spaced sheathing applications. The method of attachment for roof cladding in spaced sheathing applications preferably uses a plural component polyurethane adhesive.

BRIEF DESCRIPTION OF THE SEVERAL VIEWS OF THE DRAWINGS

The objects, advantages, and features of the invention will become more apparent by reference to the drawings which are appended hereto and wherein like numerals indicate like parts and wherein an illustrated embodiment of the invention is shown, in which:

FIG. 1 is a perspective view of the upper side of a typical roof tile that can be used with the spaced sheathing roofing system according to an embodiment of the present invention;

FIG. 2 is a perspective view of the lower side of the typical roof tile shown in FIG. 1;

FIG. 3 is a perspective view of a portion of a spaced sheathing roof assembly showing rafters with installed batten strips and roof cladding being installed;

FIG. 4 is a side elevational view of a portion of the spaced sheathing roofing system with an upper row of roof tiles overlapping each lower row of roof tiles;

FIG. 4A is an enlarged portion of FIG. 4;

DETAILED DESCRIPTION OF THE INVENTION

Figure 5:
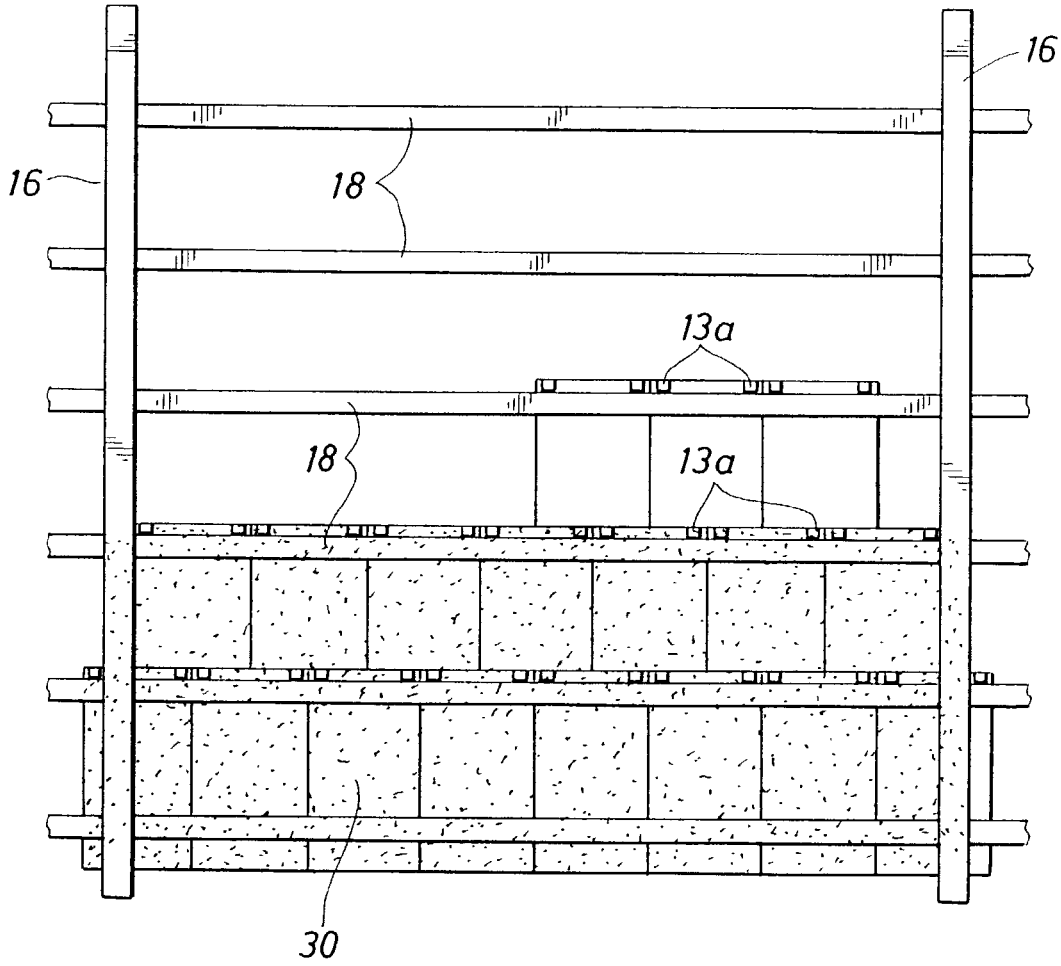
FIG. 5 is a plan view of the bottom side of two rows of placed roof tiles on the batten strips with the adhesive applied to the roof tiles, batten strips and truss members.
Figure 6:
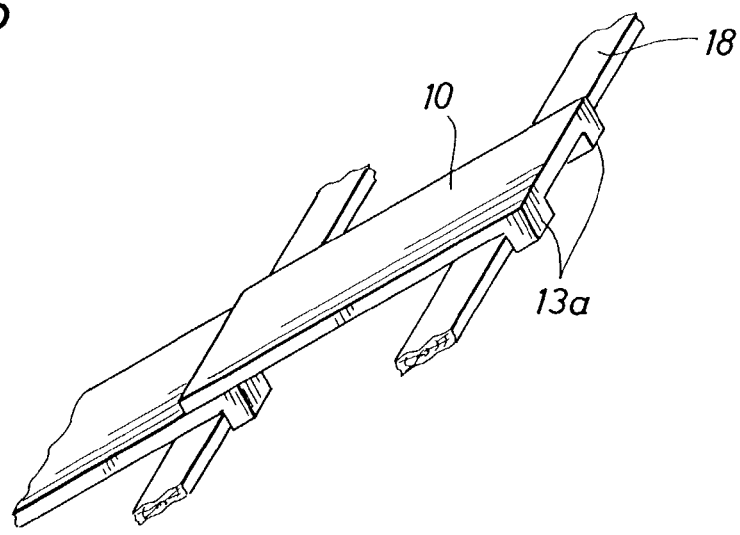
FIG. 6 is perspective view showing batten strips having roof tiles placed thereon.

The spaced sheathing roofing system and method of installing same, generally designated as 100, will now be described in greater detail with specific reference to the drawings. The spaced sheathing roof system 100 includes a roof component, designated generally as 10, known as a roof cladding or roof tile. An example of one such roof component is shown in perspective view in FIGS. 1 and 2. FIG. 1 shows the upper side and FIG. 2 shows the lower side of the roof component 10. The roof component 10 shown in FIGS. 1 and 2 is commercially available from Monier-Raymond Company. It is to be understood that the present invention 100 is not limited to the roof tile design shown in the drawings, but is equally applicable to a variety of other shapes and types of roof components well known to those skilled in the art. For example, flat roof tiles and reverse curve roof tiles can be used with the system and method 100. Typically, the tile components 10 are made from cementitious or clay materials. It is also to be understood that the system and method of the present invention 100 is not limited to clay or cementitious roof tiles 10 but is also applicable to roof components 10 made from other materials including, but not limited to, brick, stone, ferrous, plastic, wood, rubber, or bituminous materials.

As shown in FIGS. 1 and 2, the roof component 10 typically includes an interlocking connection at the first and second longitudinal edges 12 and 14, respectively, of the roof component 10, to additionally form a water lock. Referring to FIG. 3, the second edge 14 of the first roof component 10 mates with the first edge 12 of an adjoining second roof component 10. This type of interlocking connection for tile roof components 10 is well known in the art. The tile roof component 10 as shown in FIGS. 1 and 2 includes a head portion 13 and a nose portion 15. Preferably, the head portion 13 includes one or more head lugs 13*a* on the lower side of the roof component 10 for reasons which will be explained below. The lower side of the nose portion 15 may include one or more nose lugs 15*a* on the lower side of the roof component 10.

Referring to FIGS. 3 and 4, a plurality of roof truss rafters 16 for supporting the spaced sheathing roofing system 100 are installed in the house or building structure in the customary manner. The rafters 16 may have any angle of inclination as is customary in the building industry. Typically, the truss rafters 16 are on 24-inch or 16-inch centers. A plurality of batten strips 18 are secured, preferably by nails, to the upper surface 16*a* of the rafters 16. Batten strips 18 can be wooden, metal, or other construction materials such as are known to persons of skill in the art. Typically, the batten strips 18 are affixed perpendicularly to the truss rafters 16. Preferably, the batten strips 18 have a uniform width of between two to six inches and about a one inch thickness. The spacing of the batten strips 18 is dependent on the dimensions of the selected roof cladding 10. It is to be understood that the size and spacing of the batten strips will be determined based upon various factors, including but not limited to, design loads, rafter spacing, and tile type.

Still referring to FIGS. 3 and 4, the roof cladding 10 is placed in rows beginning along the lower edge of the roof. As shown in FIG. 4, preferably the roof cladding 10 is placed onto the lower batten strip 18 so that the head lug 13*a* of the roof cladding 10 is contacting the batten strip 18. The lower row of roof cladding 10 is similarly placed and preferably interlocked with the adjacent roof cladding 10. A second row of roof cladding 10 is similarly placed with the head lug 13*a* contacting the respective batten strip 18. The second row of roof cladding 10 overlaps the lower row of roof cladding 10 as shown in FIGS. 3 and 4. Preferably, the nose lugs 15*a* interengage with the upper side of the lower course of roof cladding 10 to form a weather barrier to help prevent free passage of wind, rain, etc. The additional courses of tiles are similarly placed onto the roof. If desired, the roof cladding 10 may be secured with fasteners, for example nails, to the batten strips 18. It may be desirable to fasten only a few of the tiles 10 to the batten strips 18.

Upon placing one or more courses of roof cladding 10 on the batten strips 18 of the roof, the roof cladding 10 is attached using an adhesive 30. The roof cladding attachment component 30 is preferably a polymer adhesive, and more preferably a polyurethane. Referring to FIG. 5, the adhesive 30 is preferably sprayed onto the lower surface of the placed roof cladding 10 while also being sprayed onto the batten strips 18. Although not required, the adhesive 30 may also be sprayed onto the supporting truss rafters 16. The sprayed adhesive 30 bonds the adjacent roof cladding 10 together and also bonds the roof cladding 10 to the batten strips 18 to form a monolithic structure. In addition, the sprayed layer of adhesive 30 forms an insulative layer while also forming a waterproof barrier. The adhesive layer can have any desired thickness, and preferably has a final thickness in the range of approximately two to four inches.

Preferably, the polymer adhesive 30 is a polyurethane described in greater detail below. One suitable polymer adhesive 30 and system for applying is disclosed in assignee's U.S. Pat. No. 5,362,342, issued to Murray et al., which is incorporated by reference. However, it is to be understood that the present invention is not limited to the system and adhesive disclosed in U.S. Pat. No. 5,362,342.

The polymer adhesive 30 may be a foamable or a non-foamable polymer adhesive. Preferably, the polymer adhesive 30 is a plural component, liquid polyurethane foam. The significant advantage of the plural component polyurethane foam is being able to walk on the installed roof components 10 shortly after the roof components 10 have been installed without affecting the bond between the roof components 10 as well as with the batten strips 18. The reactivity period or rise time of the plural component liquid polyurethane foam 30 of the present invention is preferably about one-half to about ten minutes and more preferably about one and one-half to about four minutes. During the reactivity period, the preferred liquid polyurethane foam 30 is an expanding foam, which fills gaps and imperfections. The resulting foam 30 provides excellent bonding between the roof components 10 and also with the batten strips 18 due to the adhesive properties of the urethane.

Plural component polyurethane insulating adhesives that may be used for this application may be carbon dioxide blown, hydrocarbon blown, fluorocarbon blown (141b, 245fa or equivalent) or gaseous fluorocarbon blown (R22, 134a, 142b or equivalent) or any combination of these materials. It is particularly advantageous to use an insulating foam adhesive blown with gaseous blowing agents due to the simplicity of the application. The simplicity of application includes low pressure, low velocity spray equipment requiring no preheated chemical components or equipment. One such system of equipment suitable for use with the present invention is disclosed in assignee's U.S. Pat. No. 5,362,342. A low velocity spray application reduces airborne particulates and unwanted overspray reducing job clean-up expenses. Low velocity spray equipment is substantially lower in cost, does not require an electrical supply source and is more easily maintained. It is to be understood that various other types of equipment may be used to apply the adhesives in practicing the present invention. Preferably, the plural component polyurethane insulating adhesive includes "A" and "B" components. The isocyanate or "A" component of the chemical system is polymeric methylene diisocyanate (PMDI) and may contain surfactant and a blowing agent. The resin or "B" component of the chemical system is a blend of polyglycols which includes sucrose glycerine, mannic, polyethylene, polypropylene and polyester polyols combined with appropriate amounts of amine and metal catalysts and cell control surfactants. The resin blend will also contain the selected blowing agent.

The foamable liquid polyurethane 30 is preferably a froth foam. Froth foam chemistry is well known in the art of urethane foams. The froth foam may be formed by using blowing agents such as hydrogenated chlorofluorocarbon R22 (HCFC-R22), hydrogenated fluorocarbon 134a (HFC-134a), or chlorofluorocarbon R12 (CFC-R12). Preferably, the froth foam 30 is formed by using the hydrogenated blowing agents HCFC-R22 or HFC-134a, and not CFC-R12 due to CFC-R12's reported deleterious effects to the earth's ozone layer.

In the preferred method, the froth foam 30 has a consistency similar to a foamy shaving cream. The froth foam is preferable over other types of foams because it can be neatly and accurately dispensed without blowing or overspraying onto other areas of the roof. The preferred liquid polyurethane 30 with its shaving cream consistency does not run when placed onto a steeply pitched roof, but remains where it is sprayed. This ensures that the adhesive bond will be formed at the appropriate locations of the roof component 10. Additionally, the froth foam 30 begins expanding immediately upon application to the roofing component 10 and batten strip 18 and results in a firm bond between adjacent roofing components 10 and the batten strips 18.

The liquid polyurethane 30 preferably has a density of about one to about eight pounds per cubic foot. It may be desirable to minimize the density of the liquid polyurethane 30 to minimize the weight on the roof while still providing an excellent bond. It has been found to be more preferable to have a foam density of about one and one-half to about two pounds per cubic foot. The application rate of the liquid polyurethane 30 is preferably about one to about six pounds per minute and more preferably about two to about three pounds per minute.

Preferably, the foamable liquid polyurethane 30 expands and fills the gaps between the batten strip 18 and the roof component 10 and gaps between the roof components 10. The excess foam continues expanding and provides further bonding with adjacent surface areas of the roof components 10.

Referring to FIG. 5, the expanding foam 30 also provides a bond between the upper roof component 10 and the lower roof component 10 at the overlapping portion where the expanding foam can fill any gap between the two roof components 10. This further enhances the overall bonding capacity of the roof components 10 to the roof.

Although the use of polyurethane spray foam on flat roof decks is an accepted practice, such applications are on the exterior surface of a closed deck system. The deck is generally wood, concrete or steel and the spray foam must be protected from U.V. degradation using multiple inches of stone or a coating of acrylic or silicone. The application of the plural component polyurethane insulating adhesive of the present invention is applied to the underside of the roof cladding and is not exposed to U.V. degradation, thus requiring no after coating.

It is to be understood that the present invention insulates the roof to provide a more energy efficient house or building and maintains better control over attic temperatures. The present invention may be employed as an after market application or in a new construction and is equally beneficial in commercial construction as well as residential. The present invention may be a substitute for a conventional pitched roof system thus eliminating the need for plywood decking and felt.

One embodiment of a pitched roofing system and method of installing same according to the present invention has thus been set forth. However, the invention should not be unduly limited to the foregoing, which has been set forth for illustrative purposes only. Various modifications and alterations of the invention will be apparent to those skilled in the art, without departing from the true scope of the invention.

We claim:

1. A method of installing a spaced sheathing roofing system on a plurality of spaced batten strips supported by a plurality of spaced truss rafters and unsupported between the spaced truss rafters, the method comprising the steps of:

positioning a plurality of roof tiles into a plurality of overlapping rows of roof tiles on the batten strips, each row having roof tiles positioned on the supported and unsupported portions of the batten strips; and then, securing the plurality of overlapping rows of positioned roof tiles to the batten strips by applying an adhesive to the batten strips and an underside of the roof tiles while the overlapping rows of positioned roof tiles remain positioned on the batten strips.

2. The method of claim 1, wherein said step of applying an adhesive comprises spraying adhesive on the underside of the roof tiles.

3. The method of claim 2, wherein said step of applying an adhesive includes spraying adhesive on the batten strips.

4. The method of claim 1, wherein the adhesive is a polymer adhesive.

5. The method of claim 1, wherein the adhesive is a polyurethane foam.

6. The method of claim 5, wherein the polyurethane foam is a froth liquid polyurethane foam.

7. The method of claim 5, wherein the polyurethane foam is a plural component polyurethane foam.

8. The method of claim 5, wherein the polyurethane foam has a density of about one to about four pounds per cubic foot.

9. The method of claim 5, wherein the polyurethane foam has a reactivity period of about one half to about ten minutes.

10. The method of claim 1, wherein said step of applying an adhesive comprises spraying an expanding polymer adhesive on the batten strips and the underside of the roof tiles to form a continuous layer to waterproof the roofing system.

11. The method of claim 1, wherein said step of applying an adhesive comprises spraying an expanding polymer adhesive on the batten strips and the underside of the roof tiles to form a continuous layer to insulate the roofing system.

12. A method of installing a spaced sheathing roofing system on a plurality of batten strips spanning across truss rafters, the truss rafters having an upper surface, the method comprising the steps of:

positioning a plurality of roof tiles into rows on the batten strips; and with the rows of positioned roof tiles on the batten strips, spraying a polymer adhesive from beneath the truss rafters' upper surface onto the batten strips and the underside of the rows of positioned roof tiles to form a continuous insulative layer for the roofing system.

13. The method of claim 12, wherein the polymer adhesive is a polyurethane foam.

14. The method of claim 13, wherein the polyurethane foam is a froth liquid polyurethane foam.

15. The method of claim 12, wherein said step of spraying a polymer adhesive secures the roof tiles to the batten strips.

16. The method of claim 15, wherein said step of spraying a polymer adhesive forms a waterproof barrier for the roofing system.

17. A method of installing an insulated, waterproof, monolithic, spaced sheathing roofing system on a plurality of truss rafters, each of the truss rafters having an upper surface, the method comprising the steps of:

placing a plurality of batten strips in direct contact with the upper surface of the plurality of truss rafters;

securing the plurality of batten strips to the plurality of truss rafters;

placing, in rows, a plurality of roof tiles onto the batten strips; and spraying, from a location below the upper surface of the truss rafters, a polyurethane adhesive onto the batten strips and the roof tiles with the roof tiles positioned on the batten strips; and allowing the adhesive to bond adjacent roof tiles together and bond the roof tiles to the batten strips to form a monolithic roof structure.

18. The method of claim 17, wherein said adhesive spraying step comprises spraying an adhesive layer on the batten strips and an exposed lower surface of the plurality of roof tiles.

19. The method of claim 18, wherein the adhesive layer has a final thickness of approximately two to four inches.

20. The method of claim 18, wherein the adhesive layer forms a monolithic layer bonded to the roof tiles, batten strips and truss rafters.

21. The method of claim 18, wherein the adhesive is a polyurethane foam.

22. The method of claim 21, wherein the polyurethane foam is a froth liquid polyurethane foam.

23. The method of claim 21, wherein the polyurethane foam is a plural component, froth polyurethane foam.

24. The method of claim 17, wherein said step of allowing the adhesive to bond forms an insulative layer.

25. The method of claim 17, wherein said step of allowing the adhesive to bond forms a waterproof barrier.

26. A method of installing an insulated spaced sheathing roofing system on a plurality of truss rafters, each of the truss rafters having an upper surface, the method comprising the steps of:

securing a plurality of batten strips to the plurality of truss rafters, placing rows of a plurality of roof tiles on the batten strips;

spraying, from below the upper surface of the truss rafters, a polymer adhesive onto the exposed lower surfaces of the batten strips and the roof tiles; and allowing the polymer adhesive to cure and form an insulative layer adjacent the lower surfaces of the batten strips and the roof tiles.

27. The method of claim 26, wherein said step of allowing the polymer adhesive to cure includes forming a waterproofing membrane.

28. A method of installing an insulated, waterproof monolithic pitched roofing system on a plurality of spaced truss rafters, the method comprising the steps of:

securing a plurality of batten strips to the plurality of truss rafters, the batten strips being unsupported between adjacent truss rafters, the batten strips secured substantially perpendicular to the truss rafters and substantially parallel and in spatial relationship with each other to define a plurality of open spaces between adjacent batten strips and adjacent truss rafters;

placing, in rows, a plurality of roof riles on the batten strips with at least some of the roof tiles loosely laying on the batten strips each row formed by placing roof tiles adjacent to each other and over the open spaces between the adjacent batten strips and adjacent truss rafters; and spraying a polyurethane adhesive onto the batten strips and a lower surface of the placed roof tiles with the roof tiles positioned on the batten strips to form an insulated, waterproof, monolithic roof structure.

29. The method of claim 28, wherein said step of placing the plurality of roof tiles on the batten strips includes loose laying the majority of the roof tiles on the batten strips.

30. The method of claim 29, further comprising the step of fastening a few roof tiles to the batten strips with nails.

31. The method of claim 28, wherein said spraying step comprises applying foam adhesive which forms a layer on the exposed roof die lower surface and the batten strips.

32. A method of installing a pitched roofing system on a plurality of spaced miss rafters, the method comprising the steps of:

securing a plurality of batten strips to the plurality of truss rafters, the batten strips being unsupported between adjacent truss rafters, the batten strips secured substantially perpendicular to the truss rafters and substantially parallel and in spatial relationship with each other to define a plurality of open spaces between adjacent batten strips and adjacent truss rafters;

placing a plurality of roof tiles on the batten strips and forming a plurality of rows of roof tiles, each row formed by placing roof tiles adjacent to each other and over the open spaces between the adjacent batten strips and adjacent truss rafters; and after placing the plurality of rows of roof tiles on the batten strips, applying an adhesive onto the batten strips and a lower surface of the placed roof tiles, while the roof tiles remain positioned on the batten strips, to secure the roof tiles to the batten strips.

* * * * *